US009277806B2

(12) United States Patent
Hallman

(10) Patent No.: US 9,277,806 B2
(45) Date of Patent: Mar. 8, 2016

(54) WALL MOUNTED ELEVATING MECHANISM

(75) Inventor: George Hallman, Washington, MI (US)

(73) Assignee: Mopec, Inc., Oak Park, MI (US)

( * ) Notice: Subject to any disclaimer, the term of this patent is extended or adjusted under 35 U.S.C. 154(b) by 1894 days.

(21) Appl. No.: 11/347,593

(22) Filed: Feb. 4, 2006

(65) Prior Publication Data

US 2006/0180057 A1 Aug. 17, 2006

Related U.S. Application Data

(60) Provisional application No. 60/652,120, filed on Feb. 11, 2005.

(51) Int. Cl.
*A47B 9/00* (2006.01)
*A47B 5/00* (2006.01)
*A61G 13/00* (2006.01)

(52) U.S. Cl.
CPC ..... *A47B 5/00* (2013.01); *A61G 13/0027* (2013.01)

(58) Field of Classification Search
USPC ..... 312/319.5–319.8, 245–247, 306, 228; 108/20, 21, 48, 147; 4/645; 5/11
See application file for complete search history.

(56) References Cited

U.S. PATENT DOCUMENTS

| | | | | |
|---|---|---|---|---|
| 2,514,563 | A * | 7/1950 | Todd | 187/233 |
| 4,568,132 | A * | 2/1986 | Watt | 312/312 |
| 4,650,171 | A | 3/1987 | Howorth | |
| 4,652,202 | A * | 3/1987 | Kersten | 414/648 |
| 5,083,514 | A * | 1/1992 | Schwartz et al. | 108/147 |
| 5,230,109 | A * | 7/1993 | Zaccai et al. | 4/645 |
| 5,244,433 | A | 9/1993 | Utterback | |
| 5,303,659 | A | 4/1994 | Berlin et al. | |
| 6,279,510 | B1 | 8/2001 | Batterton | |
| 7,073,464 | B2 * | 7/2006 | Keil | 119/753 |

* cited by examiner

*Primary Examiner* — Daniel J Troy
*Assistant Examiner* — Timothy M Ayres
(74) *Attorney, Agent, or Firm* — Raggio & Dinnin, P.C.

(57) ABSTRACT

A wall mounted elevating mechanism that includes a frame and a sliding member arranged therein. The elevating mechanism also includes a support arm extending from the sliding member with a table secured to the support arm. A lifting mechanism is arranged between the frame and the sliding member. A switch is electronically connected to the lifting mechanism.

23 Claims, 6 Drawing Sheets

Fig 1
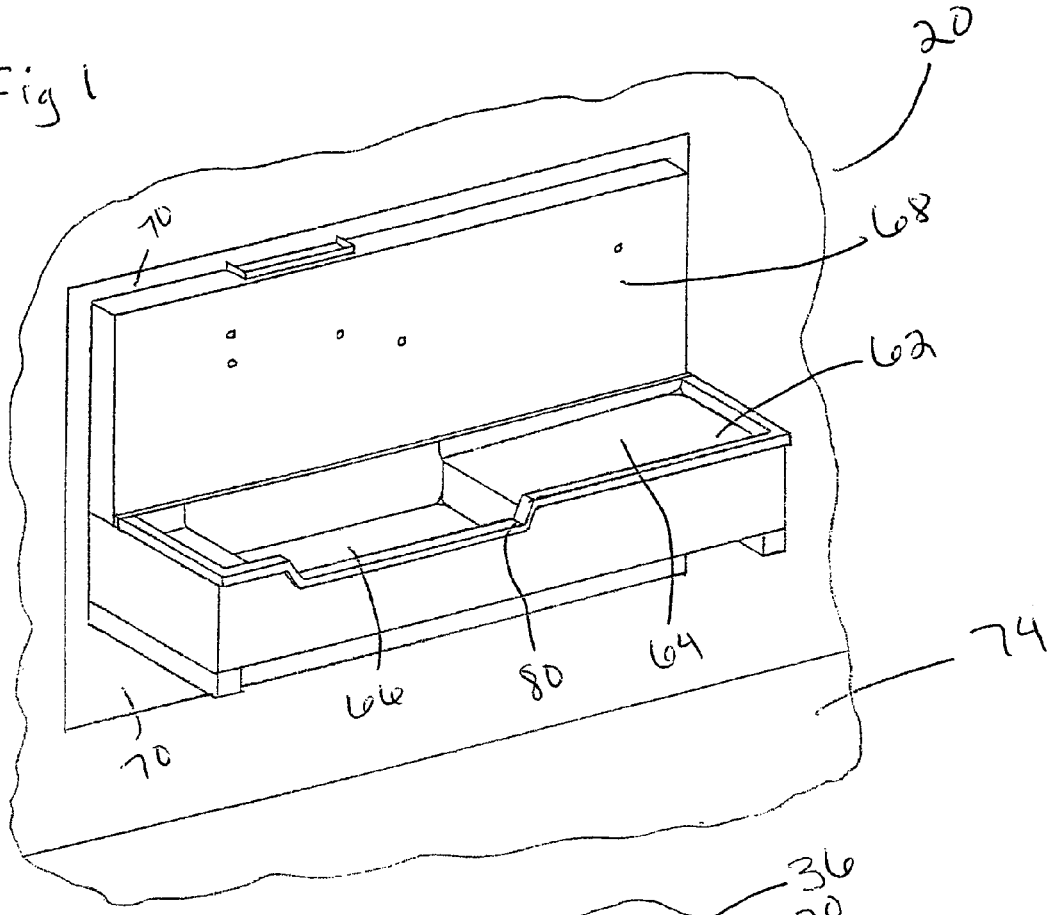
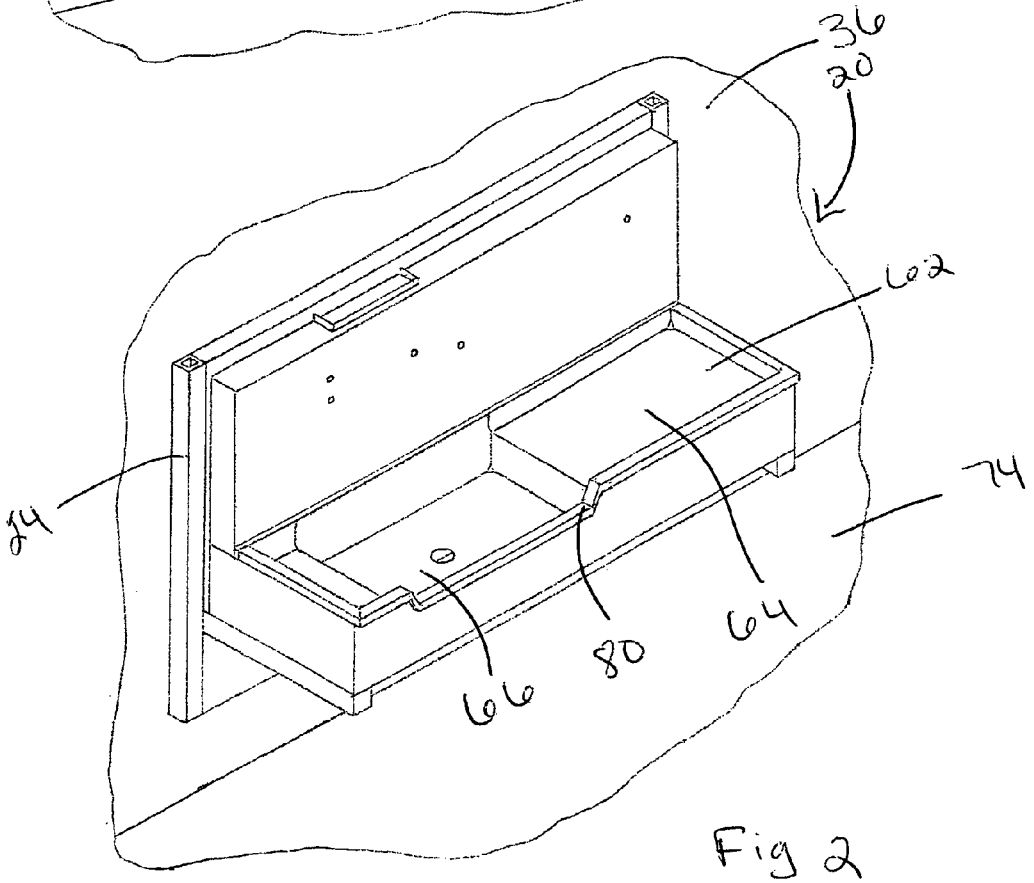
Fig 2

Figure 5
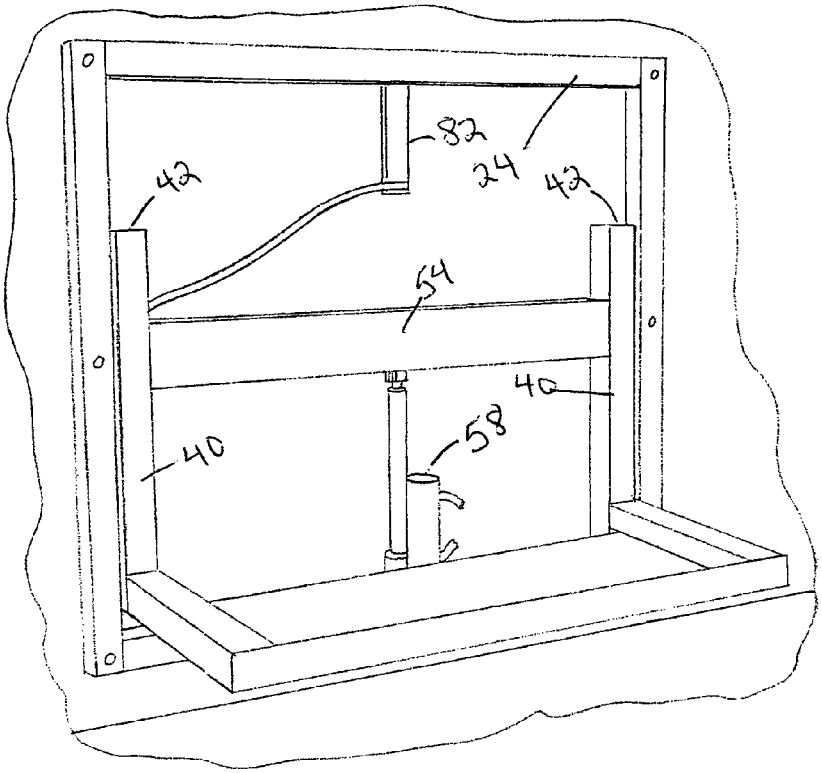
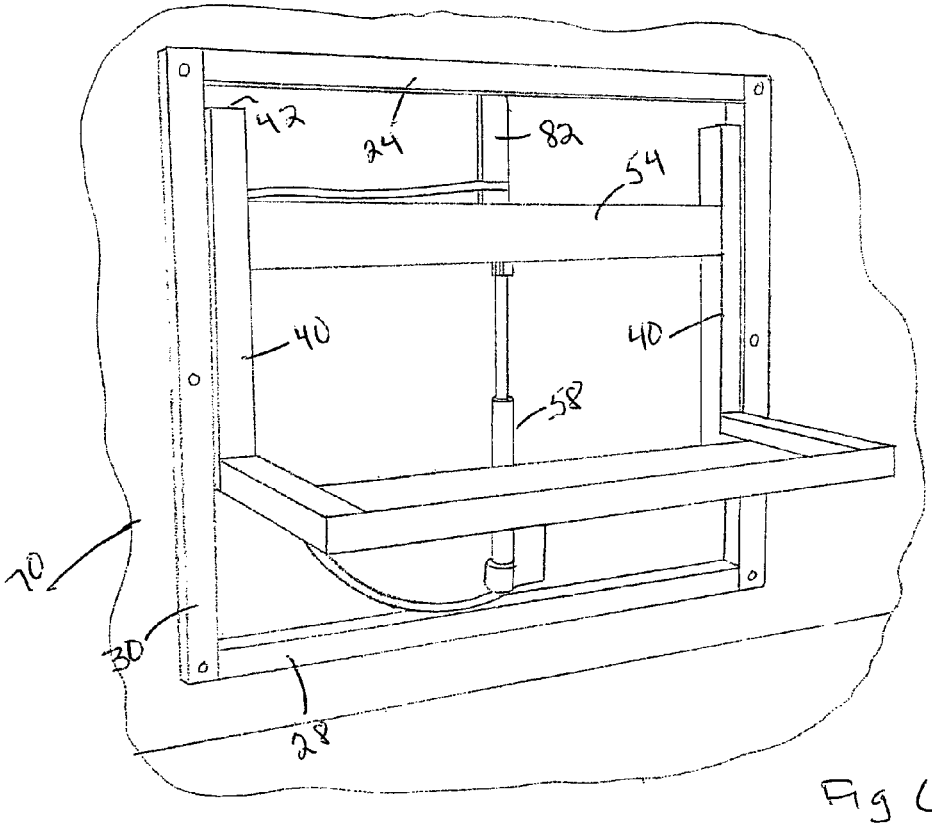
Fig 6

WALL MOUNTED ELEVATING MECHANISM

This application claims the Benefit of Provisional Application Ser. No. 60/652,120 filed Feb. 11, 2005

BACKGROUND OF THE INVENTION

This invention generally relates to a wall mounted elevating mechanism and more particularly relates to a wall mounted elevating mechanism for use in an adjustable working area having autopsy/necropsy sinks and grossing work stations.

Autopsy tables, grossing tables, necropsy tables and trimming tables are all well known in the art. These tables are designed to accommodate a body or other part of a body while a post mortem examination is carried out or pathology is conducted on an organ or other body part. Many of these autopsy tables in the prior art were made of simple ceramic slabs with no exhaust systems. Recently these prior art autopsy tables have been made of a stainless steel having a discontinuous or perforated surface. These tables may have ventilation systems to reduce the odor associated with chemicals and natural fluids and components that are associated with an autopsy or pathology procedure. The use of ceramic slabs or stainless steel create an easy to clean surface that generally are non porous and easy to disinfect after each autopsy or pathology procedure is conducted.

Many of these prior art autopsy tables include an assortment of components used in conjunction therewith. For instance, an autopsy table may include a plurality of faucets that are used for transferring liquids, gas, or vapors to the autopsy table. Such liquids can be formaldehyde, other chemicals, water, or any other type of chemical or substance needed during an autopsy or pathology procedure. The autopsy tables generally also include an air system that includes an air intake and air exhaust vents that may also include filters and like to constantly clean the air and reduce odors from the autopsy table and surrounding environment. Furthermore, sinks are generally located within an autopsy table. Grating surfaces may also be found on the autopsy table for allowing fluids to be removed and collected during autopsy of the human or animal body. Furthermore, autopsy tables may also be arranged such that a gurney or cart may be used in conjunction with the autopsy table for delivering the body or for holding the body during the autopsy procedure. The gurney or cart is capable of being secured in position against a predetermined surface of an autopsy table and may also be inclined to any required angle necessary for the user performing the autopsy.

Prior art autopsy tables have generally been used in fixed positions in a post mortem room, hospital, laboratory or the like. These tables are fixed in a position that is convenient for a predetermined average size human to conduct the work of the autopsy or pathology procedures in a comfortable, non-stress inducing manner in a standing or seated position.

One problem associated with prior art autopsy, necropsy, or grossing tables is that they are fixed at a single height and are not adjustable to provide an ergonomically friendly use for people of various heights. Another problem with prior art autopsy tables is that many of them are not wall mounted and require increased space for use in a room and require a stronger base to support the autopsy table during the autopsy procedure. The prior art includes some wall mounted autopsy tables that are arranged at a fixed height for a predetermined average sized individual. These autopsy tables are not capable of being adjusted to users of different heights and statures, thus creating ergonomic issues for those having to perform autopsies in uncomfortable and sometimes painful positions because of the height of the autopsy table.

Therefore, there is a need in the art for an autopsy table that is capable of being mounted on or off a wall and having a mechanism that will elevate the work surface to a users selected height. This will create an ergonomically friendly environment for performing an autopsy. The ergonomically friendly environment will reduce stress, increase productivity and reduce worker injuries due to repetitive motions performed at awkward angles for those working at a table not properly fitted to their respective stature and height.

SUMMARY OF THE INVENTION

One object of the present invention is to provide a novel and unique wall mounted elevated mechanism.

Another object of the present invention is to provide a novel and unique wall mounted autopsy sink or grossing work station that is capable of being adjusted to various heights to accommodate different size users.

Still another object of the present invention is to provide a wall mounted autopsy sink or grossing work station that is recessed within a wall and/or connected to a predetermined surface of a wall.

Still another object of the present invention is to provide an autopsy sink or grossing work station that is capable of being lowered and raised within a predetermined range by a single user.

Another object of the present invention is to provide a wall mounted autopsy table that is capable of reducing stress on the user during the performance of an autopsy, and increasing the productivity of the users.

Still another object of the present invention is to provide an autopsy work station that is capable of use in hospitals, laboratories, morgues, funeral homes, etc.

According to the present invention, the foregoing and other objects and advantages are obtained by a novel design for a wall mounted elevating mechanism for use with an autopsy table and the like. The wall mounted elevated mechanism for use with an autopsy table includes a generally rectangular or square shaped frame. A sliding member is arranged within the frame and is capable of movement with respect to the frame over a predetermined length. A beam is arranged between a first and second sliding member and provides support to the sliding members along with a lifting surface for a lifting device. A support arm extends from near one end of the sliding member and will provide a surface for which an autopsy table or grossing work station is secured. The autopsy table will include a horizontal work surface along with a vertical back wall. The autopsy table will have a switch located on it to control a lifting mechanism. The lifting mechanism will lower or raise the autopsy table within a predetermined range of heights. The autopsy table will be capable of vertical movement with respect to the floor of the lab, hospital or other room used for the autopsy. The wall mounted autopsy table may be mounted to the surface of a wall in the lab or room or the frame will be recessed within the wall a predetermined distance equal to the thickness of the wall. Thus, if the wall mounted elevating mechanism is recessed within the wall all moving parts will be located within the thickness of the wall of the room in which the autopsy is to be performed. This will increase economical use of the room and reduce the space needed for performing the autopsy and mounting the autopsy equipment.

Other objects, features and advantages of the present invention will become apparent from the subsequent description and appended claims taken in conjunction with the accompanying drawings.

BRIEF DESCRIPTION OF THE DRAWINGS

FIG. 1 shows a perspective view of a wall mounted autopsy table having an elevating mechanism according to the present invention.

FIG. 2 shows a wall mounted autopsy table with the frame in phantom according to the present invention.

FIG. 5 shows an autopsy system including a wall mounted autopsy table according to the present invention.

FIG. 6 shows a back view of a wall mounted autopsy table in its fully lowered position according to the present invention.

Figure 3:
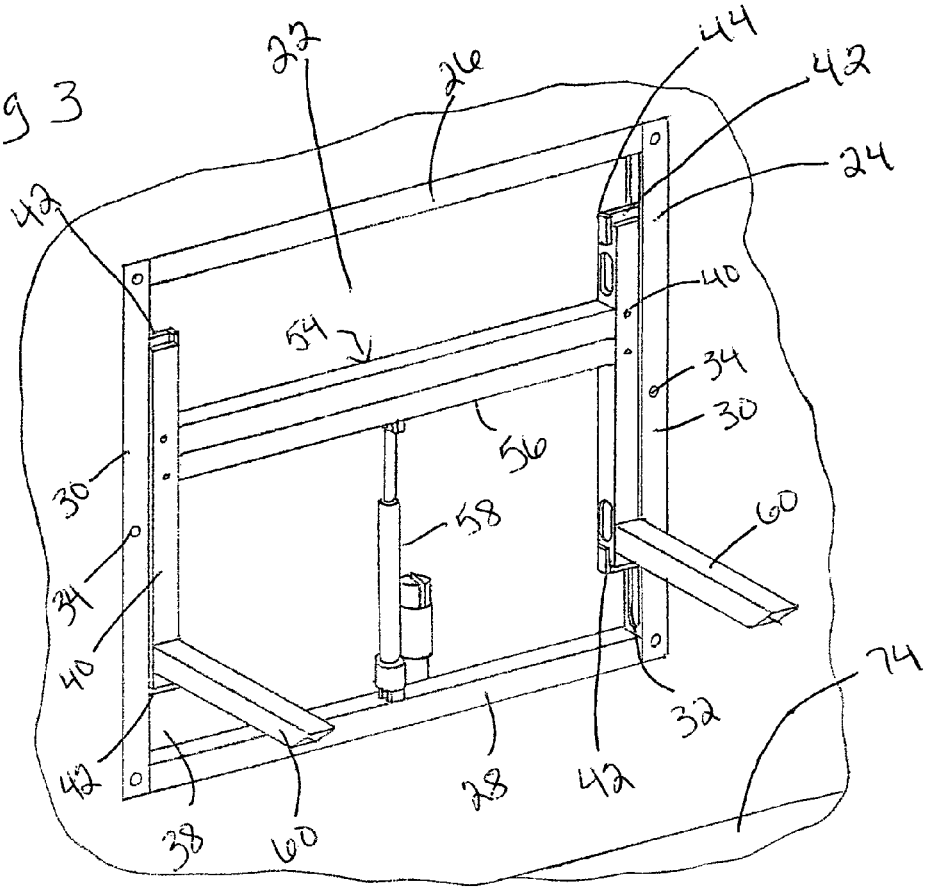
FIG. 3 shows a wall mounted autopsy table frame recessed within a wall according to the present invention.

DESCRIPTION OF THE PREFERRED EMBODIMENT(S) AND BEST MODE FOR CARRYING OUT THE INVENTION

Referring to the drawings, FIGS. 1-9 show a wall mounted autopsy sink 20 having an elevating mechanism according to the present invention. It should be noted that the wall mounted elevating mechanism 22 can be used on any known autopsy table, necropsy table, grossing work station, trimming work station, pathology work station, or the like all of which are for use in hospitals, morgues, funeral homes, university laboratories, other laboratories and any other structure that can be used for examining human or animal bodies or human and animal body parts. The wall mounted autopsy sink 10 of the present invention includes a frame 24 which generally has a rectangular or square shape. However, it should be noted that any other known shape may be used for the frame 24 depending on the design requirements and work environment for the autopsy sink 10. The frame 24 will have a top member 26, a bottom member 28 and two side members 30 which are connected at ends thereof to form the general square or rectangular shape for the frame 24. In cross section the frame 24 will generally have a square like appearance. However, it should be noted that any other shaped frame members may be used to construct the frame 24. The side members 30 of the frame 24 will generally have a U-shaped cross section with a channel 32 extending along substantially the entire length thereof. Some or all of the frame members 26, 28, 30 will also have a plurality of orifices 34 therethrough for use in connecting the frame 24 to a wall 36 or recessed portion of a wall 38 within a laboratory or other autopsy type environment. The orifices 34 will generally be circular in shape but may be any other shape depending on the fastener used to secure the frame 24 to the wall 36.

Slidably arranged within the frame 24 is a first and second sliding member 40. The sliding members 40 will be arranged adjacent to or within the channel 32 of the frame member 30. Each of the sliding members 40 generally has a rectangular box like shape. In cross section the sliding members 40 generally have a square like cross section. On each end of the sliding members 40 is located a guide member 42 which will be aligned within and slidably move along the channel 32 of the frame member 30. The guide members 42 will ensure that the sliding members 40 are aligned in a predetermined position with relation to the frame 24. The guide members 42 will allow the sliding member 40 to move in an up and down motion with relation to the frame 24. A fastener 44 is located on an outside portion of the guide member 42 and connected to the sliding member 40. The fastener 44 will allow the guide member 42 to be inserted into the channel 32 such that the guide member 42 engages a back wall of the channel 32 to ensure for proper sliding engagement between the sliding member 40 and the frame 24. It should be noted that it is contemplated to have a roller system attached to an end of the guide members 42 to allow for smooth and near friction free rolling between the frame 24 and sliding member 40. The sliding member 40 will have a plurality of orifices 46 through multiple sides and surfaces thereof. The orifices 46 will be used to connect the sliding member 10 to various components.

Figure 9:
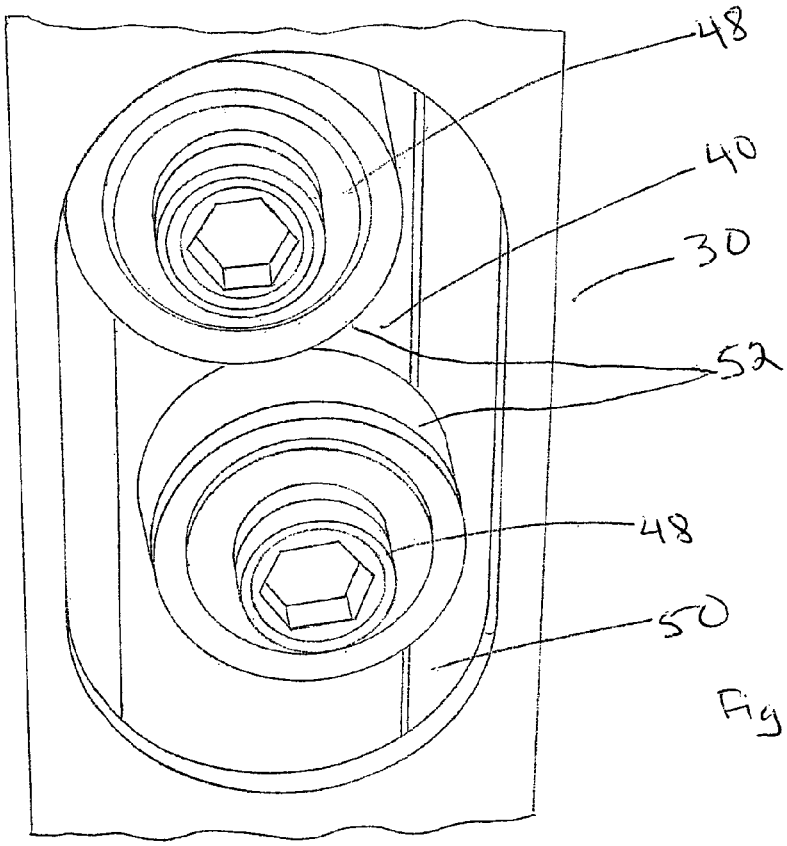
FIG. 9 shows a close up of fastening members used to connect the sliding member to the frame.

As shown in FIG. 9, the sliding member 40 is connected to the frame member 30 via an orifice 46 through a surface of the sliding member 40. A fastener 48 is placed in orifice 46 and contacts a surface of the channel 32 of the frame member. The fasteners 48 will have a shoulder portion via a bushing, roller bushing 30, a washer, or a nut head to allow for interaction with a flange 50 extending towards the opening of the channel 32 on the frame member 30. The bushing or roller 52 will be secured against the flange 50 thus securing the sliding member 40 to the frame member 30 via the fasteners 48. As shown in FIG. 9 two fasteners 48 are used to secure the sliding member 40 to the frame member 30 in a manner that will still allow for sliding or rolling engagement and movement between the frame member 30 and the sliding member 40.

A beam 54 is arranged between the first and second sliding member 40 at a predetermined position. As shown in the present invention, a double beam 54 is used to increase the strength and rigidity of the sliding members 40 and elevating mechanism for the autopsy sink 20. Any known fasteners can be used to connect the beam 54 to the sliding members 40. It should be noted that the fasteners may be any known nut and bolt, dowel, pin, screw or other mechanical device along with chemical bonding means such as epoxies, glues, or the like. It is also contemplated to use welding or other fastening techniques to secure the beams 54 to each other or to the sliding members 40 and the frame 24. The beam 54 includes a lifting surface 56 on one end thereof.

A lifting device 58 is arranged between the lifting surface 56 of the beam 54 and a surface of the bottom frame member 28. In the wall mounted autopsy sink 20 shown in the present invention a linear actuator 58 is arranged at a mid point of the beam 54 and a mid point of the bottom member of the frame 28. The linear actuator 58 may be any known type of actuator capable of producing linear motion and capable of lifting a predetermined amount of weight. The linear actuator 58 may be any known pneumatic actuator, air driven actuator, gas driven actuator, fluid driven actuator, electronic actuator, electromechanical actuator, or any other known device capable of creating a linear motion. In the preferred embodiment a hydraulic piston 58 is used to create the necessary force to move the autopsy sink 20 and hold the autopsy sink 20 at predetermined heights. It should be noted that it is also contemplated to use multiple linear actuators between the beam 54 and frame 28 depending on the size of the autopsy equipment to be moved and the weight of the equipment to be moved. It should also be noted that any other type of lifting mechanism other than a linear actuator may also be used. A screw type actuator, a scissor type actuator, or any other known lifting device may be used to create the necessary lift forces for the autopsy sink 20 according to the present invention.

A support arm 60 extends from each of the sliding members 40 from a surface thereof. The support arms 60 will be fastened to the sliding members 40 by any known fastener or any known fastening technique including welding, laser welding, arc welding, chemical bonding, mechanical bonding, etc. The support arms 60 will extend a predetermined distance from the sliding members 40 in a generally perpendicular manner. Generally, the support arms 60 will extend a distance equal to or less than the width of the autopsy sink 10. The support arms 60 shown in the present invention have an angled end on one end thereof. This angled end will be used to create an ergonomically and aesthetically pleasing support member for the autopsy sink 10 in the laboratory environment. The support arm 60 generally has a rectangular box like shape with a square cross section, however any other known shape or sized support arm 60 may be used for the present invention depending on the design requirements and the laboratory environment the table will be used in.

An autopsy sink body 62 is arranged on the top surface of the support arms 60 and is connected to the support arms 60 via orifices in the support arm 60 and orifices on a bottom portion of the autopsy sink body 62. The autopsy sink body 62 will have a work surface 64 that is angled at a predetermined angle to a sink or bin 66. A back wall 68 will extend from the back edge of the autopsy sink body 62. The autopsy sink body 62 will have a predetermined width, length and height. A bottom surface of the autopsy sink body 62 will have a plurality of orifices therethrough that will mate with the plurality of orifices on the support arm 60 and allow for a securing of the autopsy sink 20 to the support arms 60 by any known fasteners. The autopsy sink 20 also will have a flange 70 extending from the outside edge thereof to cover and hide the frame 24, support arms 60 and sliding members 40 from view of the users of the autopsy equipment.

Connected to the autopsy sink 20 will be a switch 72 which will be electronically connected to the linear actuator 58 and will allow for movement of the autopsy sink 20 relative to the wall 36 and floor 74 within a predetermined range. In one embodiment the range of movement for the autopsy sink 20 will be between six inches and three feet. This range may change depending on the linear actuator 58 used and the wall space necessary for the autopsy sink 20. The autopsy sink 20 also will include at least one faucet and a plurality of other components 76 used to connect hoses, water, gas and or other chemicals necessary during the autopsy process. The autopsy sink 20 may also include drawers for storage, electrical outlets for lighting mechanisms and any necessary electronic and fan components for air ventilation systems. As shown in FIG. 5 the autopsy sink 20 will work in conjunction with an autopsy gurney or cart 78 and will have a cutout 80 arranged next to the sink 66 to allow for the autopsy cart or gurney 78 to be aligned within the cutout 80 thus partially holding the autopsy cart 78 in position with relation to the autopsy sink 20 during the autopsy of the human or animal body. As shown the autopsy gurney 78 is capable of being angled at a predetermined angle to the autopsy sink 20 or it may lay in a flat plane to the autopsy sink 20. The autopsy cart 78 is generally on wheels and may include a hydraulic system to lower and adjust the height of the autopsy cart 78. It should be noted that the autopsy sink 20 is capable of being raised and lowered to positions to match that of the autopsy gurney or cart 78. It should be noted that all of the materials described above for the wall mounted autopsy sink 20 having an elevating mechanism are generally made of a steel material and preferably a stainless steel material, however any other known metal, hard ceramic, plastic, rubber or fabric may be used for the wall mounted autopsy sink 20 and all associated components depending on the design requirements of the autopsy sink and autopsy lab.

Figure 4:
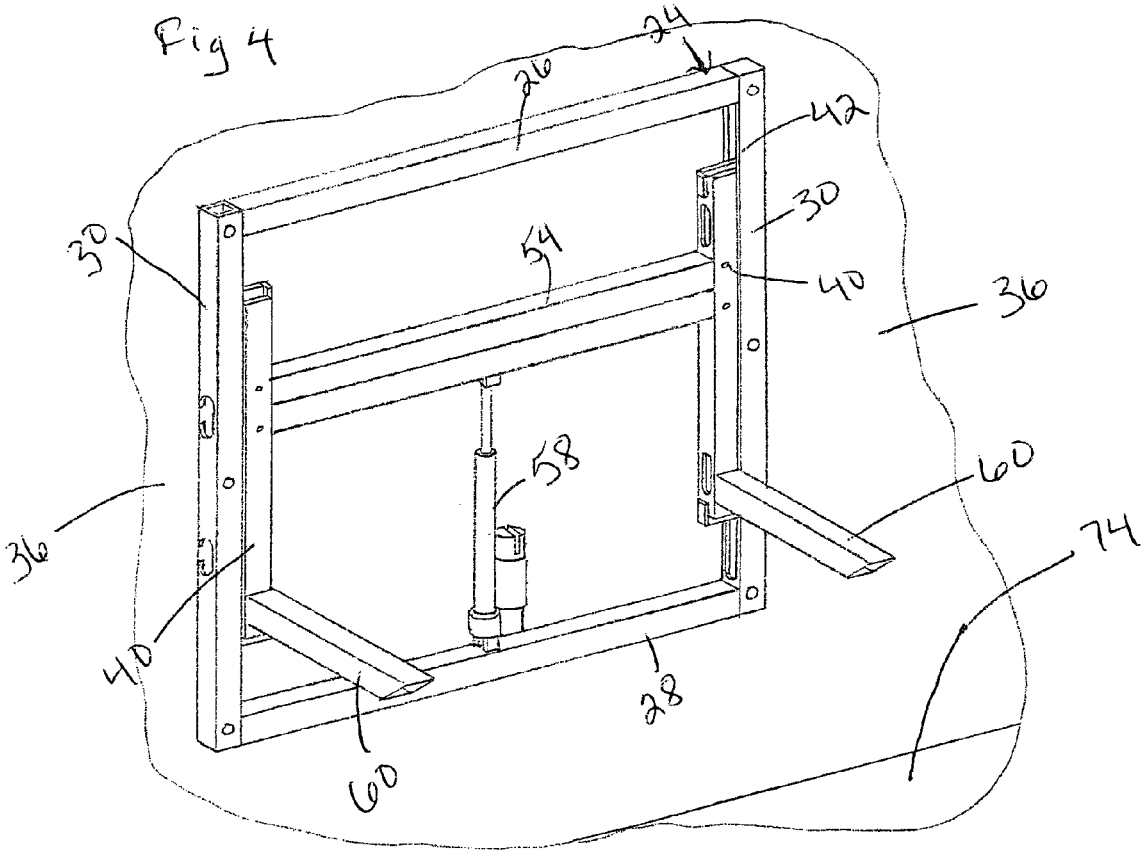
FIG. 4 shows a wall mount autopsy table frame according to the present invention mounted to the surface of a wall.

In operation the autopsy sink frame 24 is either surface mounted to the wall 36 or mounted within a recess 38 that will generally mimic the outer dimensions of the frame 24. In the case of the recessed frame 24, the frame 24 will be designed to be generally the same width as that of the wall 36 and thus when placed within the recess 38 of the wall 36 the frame 24 will be substantially flat or parallel with relation to the outer surface of the wall 36. Thus, only the autopsy sink 20 will extend from the wall 36 and will move with relation to the wall 36 and floor 74. A surface mount directly to the wall 36 may also be done with the frame 24 as shown in FIG. 4. In this case the frame 24 will extend from the wall 36 to the predetermined thickness of the frame 24. It will operate in the same manner as the frame 24 recessed within the wall 36. The frame 24 will be secured to the wall 36 by any known fasteners.

Figure 7:
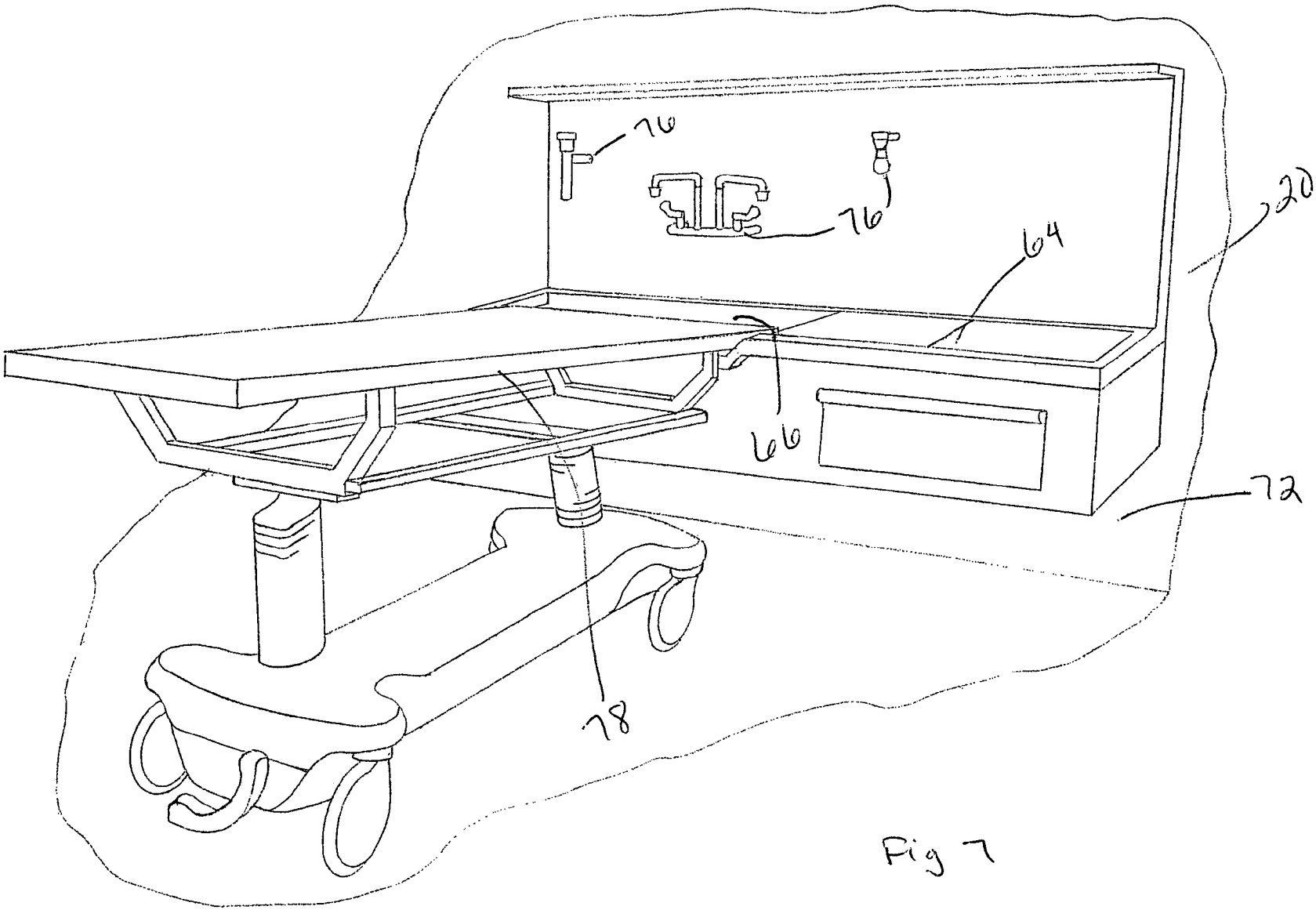
FIG. 7 shows a back view of a wall mounted autopsy table according to the present invention in its fully raised position.
Figure 8:
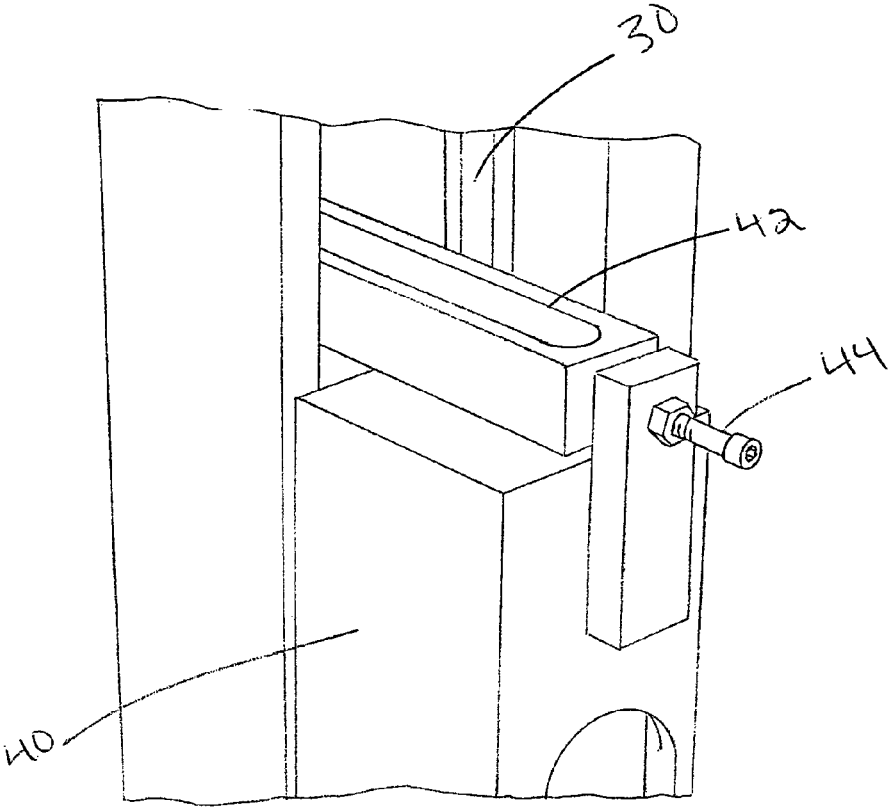
FIG. 8 shows a close up of the sliding member arranged within the frame.

As shown in FIGS. 6 and 7 the autopsy sink 20 will be capable of moving in an up, down or vertical motion between a fully up position and a fully down position. FIG. 6 shows the autopsy sink in the fully lowered or down position while FIG. 7 shows the autopsy machine in the fully raised or up position. As shown in FIG. 6 a stop arm 82 extends down from the top frame member 26. The stop arm 82 will include a sensor of any known type that will sense when the beam 54 is at its top or highest position and may be programmed to stop power flow to the linear actuator 58 and lock the linear actuator 58 in the fully raised position. When the operator wants to lower the autopsy sink 20 they will activate switch 72 which may be connected to an outer surface of the autopsy sink 22 and move the linear actuator 58 in a down or lower position thus lowering the beam 54 in relation to the floor 74. This will in turn lower the autopsy sink 20 to its lowest level. It should be noted that the linear actuator 58 will be able to be locked in any position between and including the fully raised position and the fully lowered position via any known locking mechanism for linear actuators. The linear actuator 58 will be electronically connected to the switch 72 located on an outer surface of the autopsy sink 22 and will allow for precise and easy raising or lowering of the autopsy sink for a single user of the present invention. It should be noted that it is also contemplated to have a computer controlled unit attached to the linear actuator 58 to allow for precise computer controlled activation and deactivation of the linear actuator 58.

During operation a user will be able to adjust the height of the autopsy sink 20 to fit his or her height. Thus, any user of the autopsy equipment, either tall or short, can adjust the autopsy sink 28 to a more ergonomically pleasant height that fits their stature. The operation of the elevating mechanism 20 will be controlled by a single touch switch either in an upward or other motion to raise the autopsy sink 22 or downward or other motion to lower the autopsy sink 22.

The wall mounted autopsy sink 22 having an elevating mechanism will provide an adjustable working area ergonomically correct for users of various heights and statures. The elevating mechanism will allow for mounting of any known autopsy sink, working stations, necropsy sink, pathology stations, trimming stations, or the like. The lowest position will be such that procedures can be accomplished from a sitting position as if the user would be sitting at a desk. The fully raised position would be such that the procedures can be accomplished from a sitting position on a lab type stool or from a standing position. The adjustability would also yield the ability of a tall and/or short user to adjust the table to suit his or her needs ergonomically thus reducing fatigue and increasing productivity of the lab users. Adjustability will also give the user the ability to accommodate procedures that warrant the elevating and/or lowering of the work area as needed for precise autopsy procedures and pathology procedures. The adjustability will also yield a more comfortable and user friendly environment for any person that may be handicapped and confined to the use of a wheel chair or other assisted moving device. It should also be noted that it is also contemplated to include a second motor along the autopsy sink 20 to allow for angling of the autopsy sink 20 with relation to the wall 36 the autopsy sink is mounted on.

Figure 10:
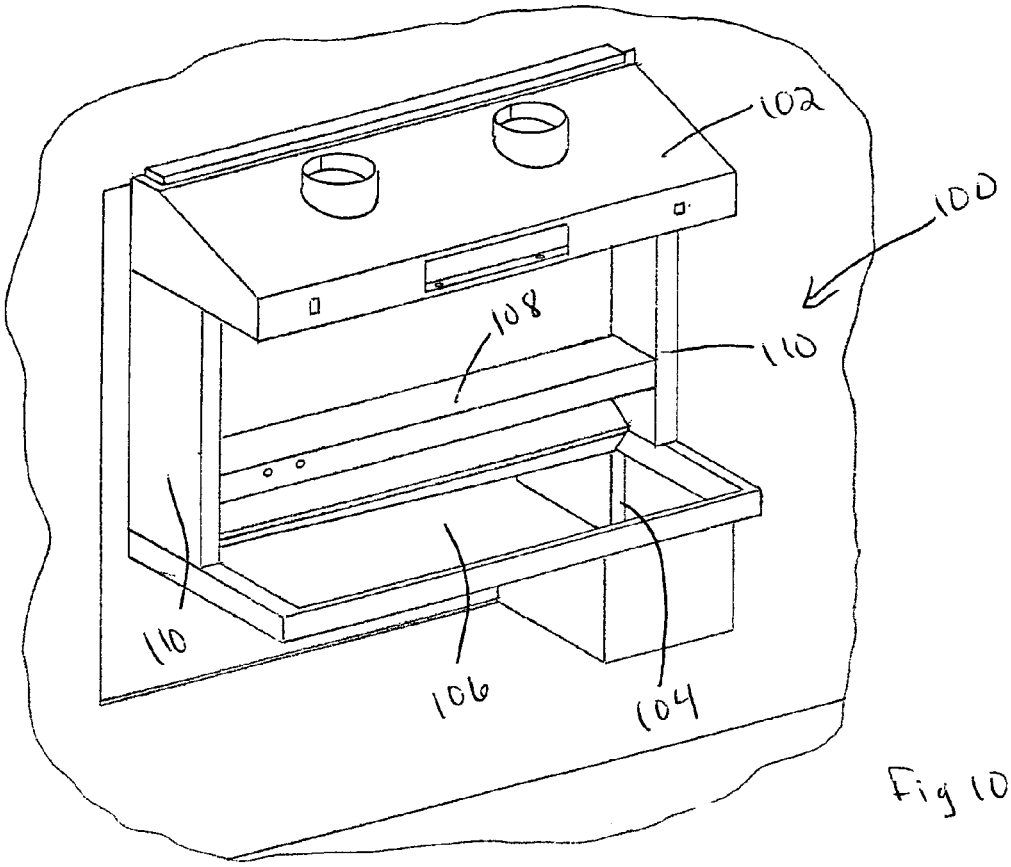
FIG. 10 shows a grossing station including a hood and sink having a wall mounted elevating mechanism according to the present invention.
Figure 11:
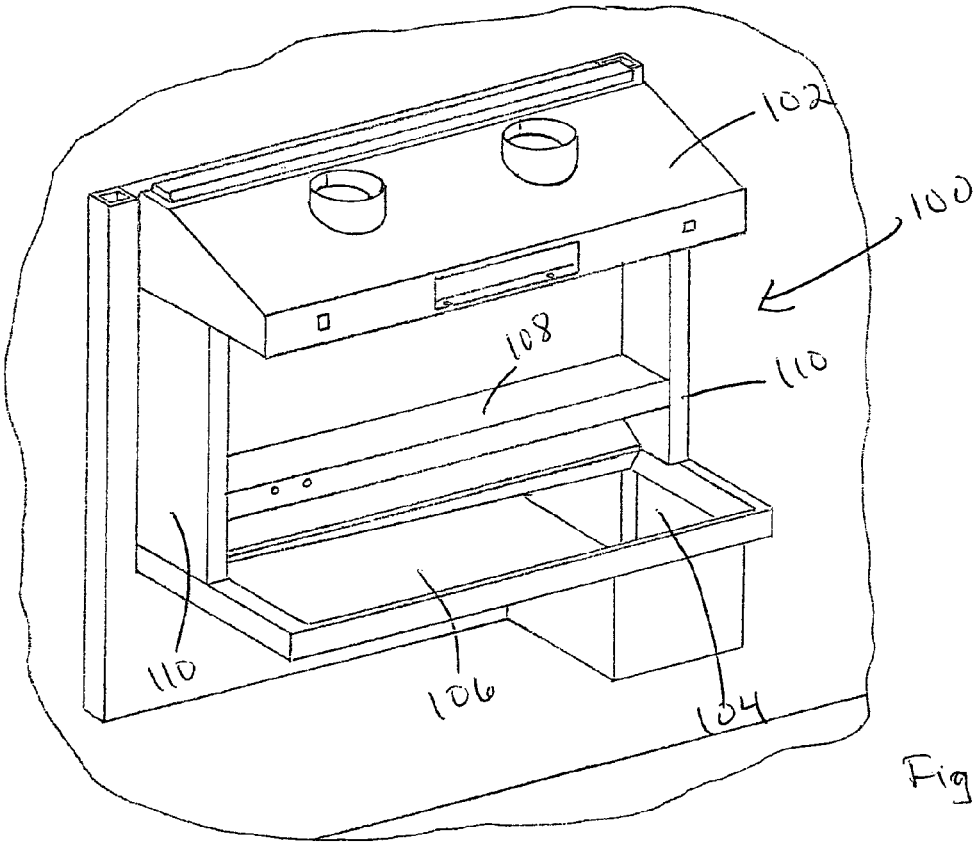
FIG. 11 shows a grossing station having a sink with the frame shown in phantom recessed in a wall according to the present invention.

FIGS. 10 and 11 show a grossing work station or pathology work station 100 according to the present invention. The grossing work station 100 includes a hood 102 having a ventilation system connected thereto which will allow for ventilation and filtering of the air within the grossing work station environment. The framing and wall mounting of the framing and elevating mechanism will be the same as that discussed above for the autopsy sink 20. The grossing station 100 generally will have a flat work surface 104 with a sink or bin 106 on one end thereof. A shelf 108 will be aligned along the back wall thereof with a hood 102 and side walls 110 extending down from the hood to the top surface of the grossing station 100. A switch will also be located on either a front or side surface of the work station to provide for raising or lowering of the work station 100 to a proper height for the user of a grossing work station 100. The grossing work 100 station will operate in the same manner as described above for the autopsy sink 20.

While it may be apparent that the preferred embodiment and the invention disclosed is well calculated to fill benefits, objects or advantages of the present invention, it should be appreciated that the invention is susceptible to modification, variations and change without departing from the proper scope of the invention as shown.

What is claimed is:

1. A wall mounted elevating mechanism for performing autopsy, necropsy and pathology procedures, said elevating mechanism including:

a frame, said frame having a top member, bottom member and two side members, all of said members being coplanar, said side members having a channel extending along a substantial length thereof, said frame mounted exclusively to the wall and suspended above a floor without engaging said floor;

a sliding member arranged within said frame;

a first and second roller arranged within said sliding member, said first roller engages a flange of said side member which is adjacent to a front surface of said side member, said second roller engages a flange of said side member which is adjacent to a back surface of said side member;

a beam contacting and extending from an inside surface of and a predetermined distance from a top of said sliding member;

a support arm extending in a perpendicular direction from a front surface of said sliding member;

a table secured to said support arm;

a sink arranged in said table;

an angled work surface arranged adjacent to said sink;

a back wall extending from a back edge of said table;

a second flange extending from an outside edge of said table;

a lifting mechanism contacting said top surface of said bottom member of said frame, said lifting mechanism contacting a bottom surface of said beam; and a switch arranged on or near said table.

2. The elevating mechanism of claim 1 wherein said frame is mounted to an outer surface of the wall.

3. The elevating mechanism of claim 1 wherein said frame is mounted within a recess of the wall.

4. The elevating mechanism of claim 1 wherein said frame generally having a square shape, said frame having a plurality of mounting orifices therethrough.

5. The elevating mechanism of claim 1 wherein said frame generally having a rectangular shape, said frame having a plurality of mounting orifices therethrough.

6. The elevating mechanism of claim 1 wherein said side members generally having a U-shaped cross section.

7. The elevating mechanism of claim 6 further including a second support arm and said rollers sliding secure said frame to said sliding member and allows for movement between said frame and said sliding member.

8. The elevating mechanism of claim 1 wherein said sliding member having a guide member secured on each end thereof, said guide members are aligned within and slidably movable within said channel.

9. The elevating mechanism of claim 1 wherein said support arm arranged near an end of said sliding member.

10. The elevating mechanism of claim 1 further including a second sliding member and said beam arranged between said sliding members, said beam having a lifting surface thereon.

11. The elevating mechanism of claim 10 wherein a bottom surface of said lifting mechanism contacting said bottom member of said frame and a top surface of said lifting mechanism contacting said beam, said lifting mechanism is coplanar with said plane.

12. The elevating mechanism of claim 1 wherein said switch is electronically connected to said lifting mechanism.

13. A table connected to a wall for use during an autopsy, necropsy, or pathology procedure, said table including:

a coplanar frame having a first and second flange extending along a predetermined portion of a surface thereof, said frame secured only to the wall and suspended above a floor without engaging said floor;

a first and second sliding member arranged and coplanar within said frame;

a guide member secured to each end of said first and second sliding member, said guide member extends into a predetermined portion of said frame;

a first and second roller arranged within said sliding members, said first roller engaging said first flange, said second roller engaging said second flange;

a support arm extending from each of said sliding members, the table secured to said support arms;

a stop arm contacting a bottom surface of a top member of said frame on one end of said stop arm, said stop arm extending toward the table from said top member of said frame;

a linear actuator arranged between said frame and said sliding members;

a sink arranged in a top surface of the table;

a work surface angled towards and directly adjacent to said sink;

a backwall extending from a back edge of the table;

a hood extending from said back wall;

a first and second side wall arranged between said hood and said top surface of the table; and a switch electronically connected to said linear actuator, said switch will control up and down movement of the table with respect to the wall.

14. The table of claim 13 further including a beam arranged between said sliding members, said linear actuator contacting a surface of said beam on one end thereof, said linear actuator is coplanar with said frame.

15. The table of claim 13 wherein said support arms extend from said sliding members near an end thereof and generally perpendicular to said frame and said sliding members, said stop arm arranged near a center point of said top member of said frame, said stop arm contacts a bottom surface of said top member with said one end.

16. The table of claim 13 wherein said frame is mounted to an outer surface of the wall.

17. The table of claim 13 wherein said frame is mounted within a recess of the wall.

18. The table of claim 13 wherein said work surface has a predetermined angle and extends from one end of said top surface to one edge of said sink, said sink arranged at one end of said top surface.

19. The table of claim 18 further including a back wall and a plurality of flanges extending from an outside edge of said back wall and the table.

20. The table of claim 19 further including a cutout portion adjacent to said sink, said cutout portion will receive a gurney or cart therein, the table will be lowered or raised to match the height of said gurney or cart.

21. The table of claim 13 further including a shelf arranged between said side walls and along said back wall of the table.

22. A method of adjusting the height of a table for use during an autopsy, necropsy or pathology procedure, said method including the steps of:

securing a coplanar frame having a top member, bottom member, and two side members to or within a wall, said frame is secured above a floor a predetermined distance without engaging said floor;

slidingly securing a sliding member within a channel of said frame with at least two rollers;

attaching the table to said sliding member;

arranging a lifting mechanism between a top surface of said bottom member of said frame and a bottom surface of said sliding member; and moving the table in an up or down motion with respect to the wall by use of a switch electronically connected to said lifting mechanism.

23. An autopsy, necropsy or pathology table for use in a room with a reinforced wall and floor, said table comprising:

a frame exclusively mounted to the wall above the floor a predetermined distance;

a sliding member arranged within and coplanar with said frame;

a support arm extending from said sliding member;

a beam in contact with said sliding member;

a lifting device in contact with said beam on one end and said frame on another end thereof;

a sink body connected to said support arm;

an autopsy cart cutout having a generally U-shape is arranged at a front edge of said sink body; and a switch electronically connected to said lifting device and arranged on said sink body.

* * * * *